US012049824B2

(12) United States Patent
Yuan et al.

(10) Patent No.: US 12,049,824 B2
(45) Date of Patent: Jul. 30, 2024

(54) DISTRIBUTED COAL CUTTING DEVICE FOR LONGWALL FACE OF COAL MINE

(71) Applicant: HENAN POLYTECHNIC UNIVERSITY, Henan (CN)

(72) Inventors: Ruifu Yuan, Henan (CN); Mengzhuo Li, Henan (CN); Shuaishuai Xie, Henan (CN); Zhiqiang Hou, Henan (CN)

( * ) Notice: Subject to any disclaimer, the term of this patent is extended or adjusted under 35 U.S.C. 154(b) by 48 days.

(21) Appl. No.: 17/873,457

(22) Filed: Jul. 26, 2022

(65) Prior Publication Data

US 2023/0340877 A1 Oct. 26, 2023

Related U.S. Application Data

(63) Continuation of application No. PCT/CN2022/095878, filed on May 30, 2022.

(30) Foreign Application Priority Data

Apr. 24, 2022 (CN) ..... 202210432898.4

(51) Int. Cl.

| | |
|---|---|
| ***E21C 25/10*** | (2006.01) |
| ***E21C 29/02*** | (2006.01) |
| ***E21D 23/00*** | (2006.01) |
| ***E21D 23/03*** | (2006.01) |

(52) U.S. Cl.

CPC ..... *E21C 25/10* (2013.01); *E21C 29/02* (2013.01); *E21D 23/006* (2013.01); *E21D 23/03* (2013.01)

(58) Field of Classification Search

CPC ..... E21C 25/10; E21C 29/02; E21D 23/006; E21D 23/03

See application file for complete search history.

(56) References Cited

U.S. PATENT DOCUMENTS 3,902,325 A * 9/1975 Sigott ..... E21D 23/06 405/295

7,182,407 B1 * 2/2007 Peach ..... E21C 25/16 299/75

FOREIGN PATENT DOCUMENTS

CN 111119884 A * 5/2020

* cited by examiner

*Primary Examiner* — Janine M Kreck

(57) ABSTRACT

A distributed coal cutting device for a Longwall face of a coal mine includes coal cutting units, where each coal cutting unit includes one coal cutting machine and two hydraulic supports, the two hydraulic supports are arranged side by side, the arrangement direction of the two hydraulic supports is parallel to the coal wall of the Longwall face, and the coal cutting machine is connected with one of the hydraulic supports. According to the device, multiple coal cutting machines are used for simultaneously carrying out coal cutting operation, and single-point coal cutting is changed into multiple-point simultaneous coal cutting, so that the coal cutting production capacity and the production efficiency are greatly improved. The multiple coal cutting machines can derive multiple control modes, so that the production flexibility and adaptability are improved.

16 Claims, 7 Drawing Sheets

DISTRIBUTED COAL CUTTING DEVICE FOR LONGWALL FACE OF COAL MINE

CROSS REFERENCE TO RELATED APPLICATION

This patent application is a continuation of International Application No. PCT/CN2022/095878, filed on May 30, 2022, which claims the benefit and priority of Chinese Patent Application No. 202210432898.4, filed on Apr. 24, 2022, the disclosures of which are incorporated herein by reference in their entireties as part of the present application.

TECHNICAL FIELD

The present disclosure relates to the technical field of coal cutting, in particular to a distributed coal cutting device for a Longwall face of a coal mine.

BACKGROUND ART

The comprehensive mechanized coal cutting technology has become a main coal cutting technology for underground coal cutting in China. The technology has the advantages that the production efficiency is high, workers are liberated from heavy physical labor, and the mining safety is improved.

At present, in the coal cutting work of fully-mechanized coal cutting process, a shearer is generally used for cutting coal on the coal wall in a reciprocating mode (the coal is peeled off from the coal wall). Subsequently, the supports and scraper execute corresponding actions to complete the coal cutting procedure along with the shearer. Only one coal cutting equipment, namely shearer, is arranged in a Longwall face in the fully-mechanized coal cutting process. So, there are some problems in the fully-mechanized coal cutting process: firstly, the coal wall of the Longwall face waits for coal cutting in a large range, a large number of supports are in a waiting state for a long time, and the coal cutting efficiency is low; secondly, along with the increase of the yield, the type, size, power and weight of the shearer are greatly increased, the equipment is difficult in manufacturing and expensive in cost, and the reliability is difficult to guarantee; and thirdly, the shearer is required to be of high environmental adaptability, and once the shearer fails, all the machines in the Longwall face can only be forced to stop production, so that working efficiency of the coal mine is seriously affected.

Therefore, how to change the current situations that in the prior art, a single shearer for the Longwall face is used for cutting coal in a reciprocating mode, and the coal cutting working efficiency is low becomes a problem urgently needed to be solved by those skilled in the art.

SUMMARY

The present disclosure aims to provide a distributed coal cutting device for a Longwall face of a coal mine to solve the problems existing in the prior art, so that the coal cutting working efficiency is improved.

In order to achieve the purpose, the present disclosure provides the following scheme. The present disclosure provides a distributed coal cutting device for a Longwall face of a coal mine, comprising:

coal cutting units, wherein each coal cutting unit comprises one coal cutting machine and two hydraulic supports, the two hydraulic supports are arranged side by side, the arrangement direction of the two hydraulic supports is parallel to the coal wall of the Longwall face, the hydraulic supports can support a roof of the Longwall face, the coal cutting machine is connected with one of the hydraulic supports, the coal cutting machine is rotatably connected with the hydraulic supports, the coal cutting machine is parallel to the coal wall of the Longwall face relative to the rotating axes of the hydraulic supports, and the coal cutting machine can carry out coal cutting operation; and the number of the coal cutting units is multiple, the multiple coal cutting units are arranged side by side, and the arrangement direction of the multiple coal cutting units is parallel to the coal wall of the Longwall face.

Preferably, the coal cutting machine is connected with the hydraulic support through a rotating assembly, the rotating assembly comprises a bottom plate, a connecting rotating disc and a connecting pin shaft, the connecting rotating disc is rotatably connected with the bottom plate, the connecting pin shaft is fixed to the connecting rotating disc, the coal cutting machine is rotatably connected with the connecting pin shaft, the rotating axis of the connecting rotating disc is perpendicular to the axis of the connecting pin shaft, and the rotating axis of the connecting rotating disc and the axis of the connecting pin shaft are parallel to the coal wall of the Longwall face.

Preferably, the rotating assembly further comprises driving arms and a connecting block, one end of each of the driving arms is hinged to the connecting rotating disc, the other ends of the driving arms are connected with the connecting block, the lengths of the driving arms can be changed, the connecting block is connected with the hydraulic support, the number of the driving arms is two, and the two driving arms are located on the two sides of the axis of the connecting rotating disc.

Preferably, the coal cutting machine comprises a roller, a first power module, a pushing arm, a machine frame and a lifting arm, the roller is in transmission connection with the first power module, the first power module can drive the roller to rotate, the rotating axis of the roller is parallel to the coal wall of the Longwall face, a plurality of picks are arranged on the peripheral face of the roller, the first power module is connected with the machine frame through the pushing arm, the length of the pushing arm can be adjusted, the pushing arm is arranged perpendicular to the rotating axis of the roller, the machine frame is connected with the hydraulic support through a first universal joint, the machine frame is connected with the lifting arm through a second universal joint, the end, away from the machine frame, of the lifting arm is rotatably connected with the connecting pin shaft, and the length of the lifting arm can be adjusted.

Preferably, the roller is slidably connected with the first power module through a translation joint, the roller is parallel to the rotating axis of the roller relative to the sliding direction of the first power module, and the translation joint is connected with a second power module.

Preferably, the roller comprises a connecting section and cutting sections, the number of the cutting sections is two, the two cutting sections are arranged at the two ends of the connecting section, the connecting section and the cutting sections are coaxially arranged, the connecting section is connected with the first power module, and the picks are arranged at the cutting sections.

Preferably, the number of the picks is multiple, the multiple picks are spirally arranged around the axis of the cutting section, and the picks on the two cutting sections are symmetrically arranged with the center line of the connecting section as the axis.

Preferably, the hydraulic support comprises a base, a caving shield, a top beam and a stand column, the top beam is arranged at the top of the base, one end of the caving shield is connected with the top beam, the other end of the caving shield is connected with the base through connecting rods, the connecting rods are rotatably connected with the base, the top beam, the caving shield and the base form a U-shaped structure, an opening of the U-shaped structure faces the coal wall of the Longwall face, the coal cutting machine is arranged in the U-shaped structure, the stand column is connected with the top beam and the base, and the height of the stand column can be adjusted.

Preferably, the hydraulic support further comprises a guard plate, the guard plate is rotatably connected with the top beam, the guard plate is arranged on the side, away from the caving shield, of the top beam, the guard plate is connected with a driving hydraulic cylinder, and the driving hydraulic cylinder can drive the guard plate to rotate.

Preferably, the hydraulic support is connected with a conveyor, the conveyor can convey coal cut by the coal cutting machine, a pushing module is arranged between the hydraulic support and the conveyor, and the pushing module can drive the conveyor and the hydraulic support to move.

Compared with the prior art, the present disclosure has the following technical effects. The distributed coal cutting device for a Longwall face of a coal mine comprises coal cutting units, wherein each coal cutting unit comprises one coal cutting machine and two hydraulic supports. The two hydraulic supports are arranged side by side. The arrangement direction of the two hydraulic supports is parallel to the coal wall of the Longwall face. The hydraulic supports can support a roof of the Longwall face. The coal cutting machine is connected with one of the hydraulic supports. The coal cutting machine is rotatably connected with the hydraulic supports. The coal cutting machine is parallel to the coal wall of the Longwall face relative to the rotating axes of the hydraulic supports. The coal cutting machine can carry out coal cutting operation. The number of the coal cutting units is multiple, the multiple coal cutting units are arranged side by side, and the arrangement direction of the multiple coal cutting units is parallel to the coal wall of the Longwall face.

The distributed coal cutting device for a Longwall face of a coal mine in the present disclosure comprises multiple coal cutting units arranged side by side. Each coal cutting unit comprises a coal cutting machine. Multiple coal cutting machines are used for simultaneously carrying out coal cutting operation, and single-point coal cutting is changed into multiple-point simultaneous coal cutting, so that the coal cutting production capacity and the production efficiency are greatly improved. The multiple coal cutting machines can derive multiple control modes, so that the production flexibility and adaptability are improved. Wherein, each coal cutting unit comprises one coal cutting machine and two hydraulic supports. The hydraulic supports can support a roof of the Longwall face. The coal cutting machine is rotatably connected with the hydraulic supports, and the operation angle of the coal cutting machine is adjusted, so that the coal cutting machine can carry out coal cutting operation on the coal wall in the range of the adjacent hydraulic supports. Under the condition that multiple coal cutting units are arranged, the coal cutting operation range of each coal cutting machine is increased as much as possible, and the coal cutting working efficiency is improved. According to the distributed coal cutting device for a Longwall face of a coal mine in the present disclosure, multi-point simultaneous coal cutting operation is achieved through the multiple coal cutting machines. The coal cutting machines can be miniaturized. The manufacturing difficulty and the using cost of the coal cutting machine are reduced. When one coal cutting machine fails, maintenance and accessory replacement are convenient. Meanwhile, other coal cutting machines can work normally, so that the coal mine production reliability is improved.

BRIEF DESCRIPTION OF THE DRAWINGS

To more clearly illustrate the embodiment of the present disclosure or the technical scheme in the prior art, the following briefly introduces the attached figures to be used in the embodiment. Apparently, the attached figures in the following description show merely some embodiments of the present disclosure, and those skilled in the art may still derive other drawings from these attached figures without creative efforts.

Reference signs: 100, distributed coal cutting device for Longwall face of coal mine; 200, coal cutting unit;

1, hydraulic support; 101, base; 102, caving shield; 103, top beam; 104, stand column; 105, connecting rod; 106, guard plate; 107, driving hydraulic cylinder; 2, coal cutting machine; 201, roller; 201*a*, connecting section; 201*b*, cutting section; 202, first power module; 203, pushing arm; 204, machine frame; 205, lifting ram; 206, pick; 207, first universal joint; 208, second universal joint; 209, translation joint; 210, second power module; 3, rotating assembly; 301, bottom plate; 302, connecting rotating disc; 303, connecting pin shaft; 304, driving arm; 305, connecting block; and 4, conveyor.

DETAILED DESCRIPTION OF THE EMBODIMENTS

The following clearly and completely describes the technical scheme in the embodiments of the present disclosure with reference to the attached figures in the embodiments of the present disclosure. Apparently, the described embodiments are merely a part rather than all of the embodiments of the present disclosure. Based on the embodiment in the present disclosure, all other embodiments obtained by the ordinary technical staff in the art under the premise of without contributing creative labor belong to the scope protected by the present disclosure.

The present disclosure aims to provide a distributed coal cutting device for a Longwall face of a coal mine to solve the problems existing in the prior art, so that the coal cutting working efficiency is improved.

To make the foregoing objective, features and advantages of the present disclosure clearer and more comprehensible, the present disclosure is further described in detail below with reference to the attached figures and specific embodiments.

Figure 1:
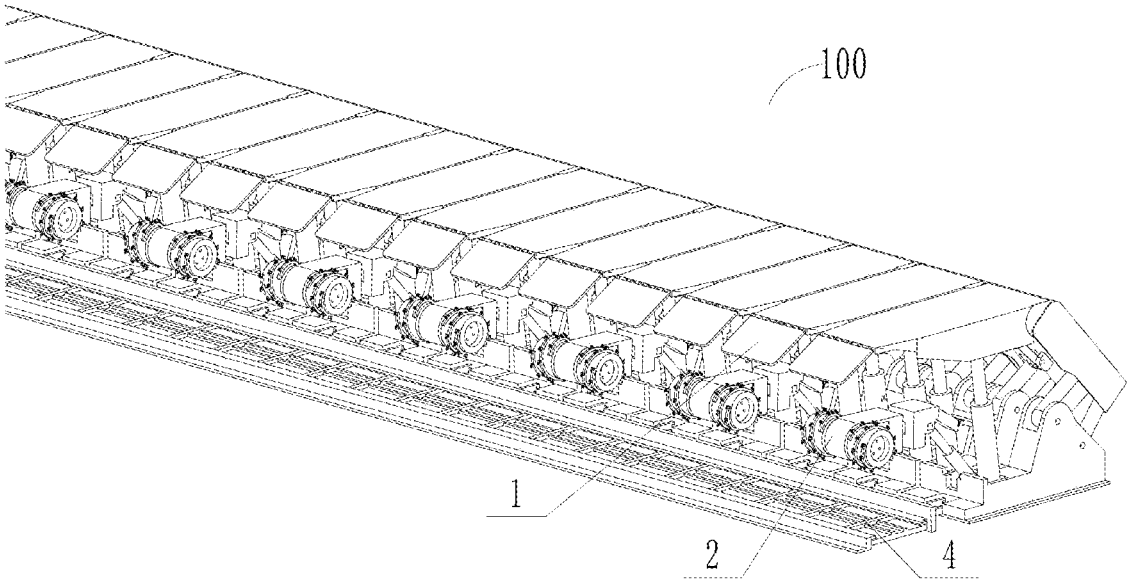
FIG. 1 is a structural schematic diagram of a distributed coal cutting device for a Longwall face of a coal mine in the present disclosure.
Figure 2:
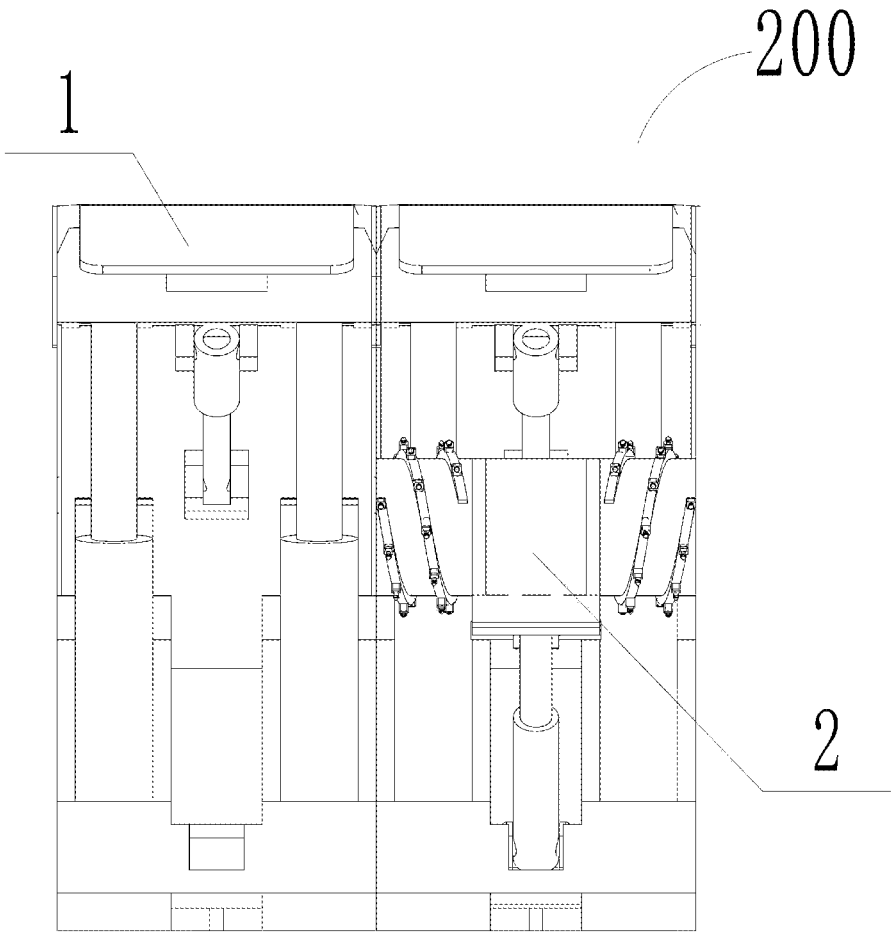
FIG. 2 is a structural schematic diagram of a coal cutting unit of a distributed coal cutting device for a Longwall face of a coal mine in the present disclosure.
Figure 3:
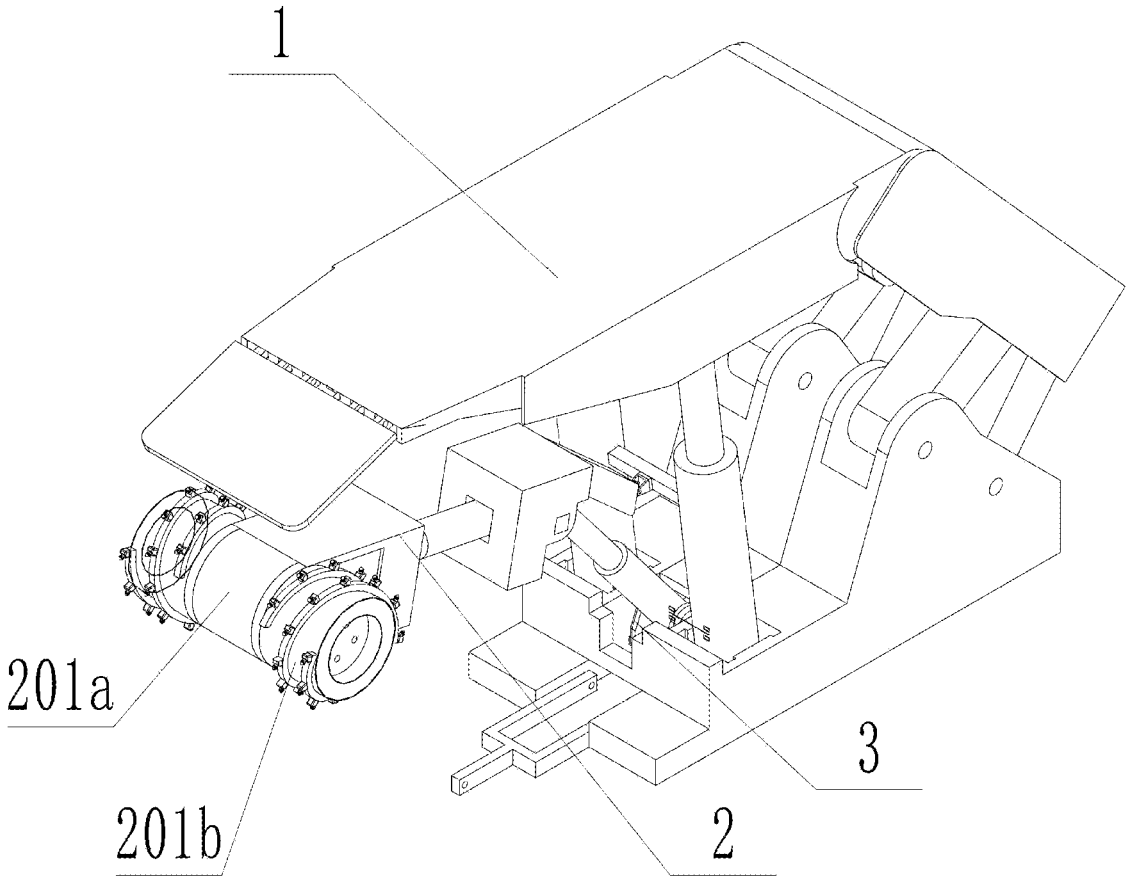
FIG. 3 is a structural schematic diagram of a coal cutting machine and hydraulic supports of a distributed coal cutting device for a Longwall face of a coal mine in the present disclosure.
Figure 4:
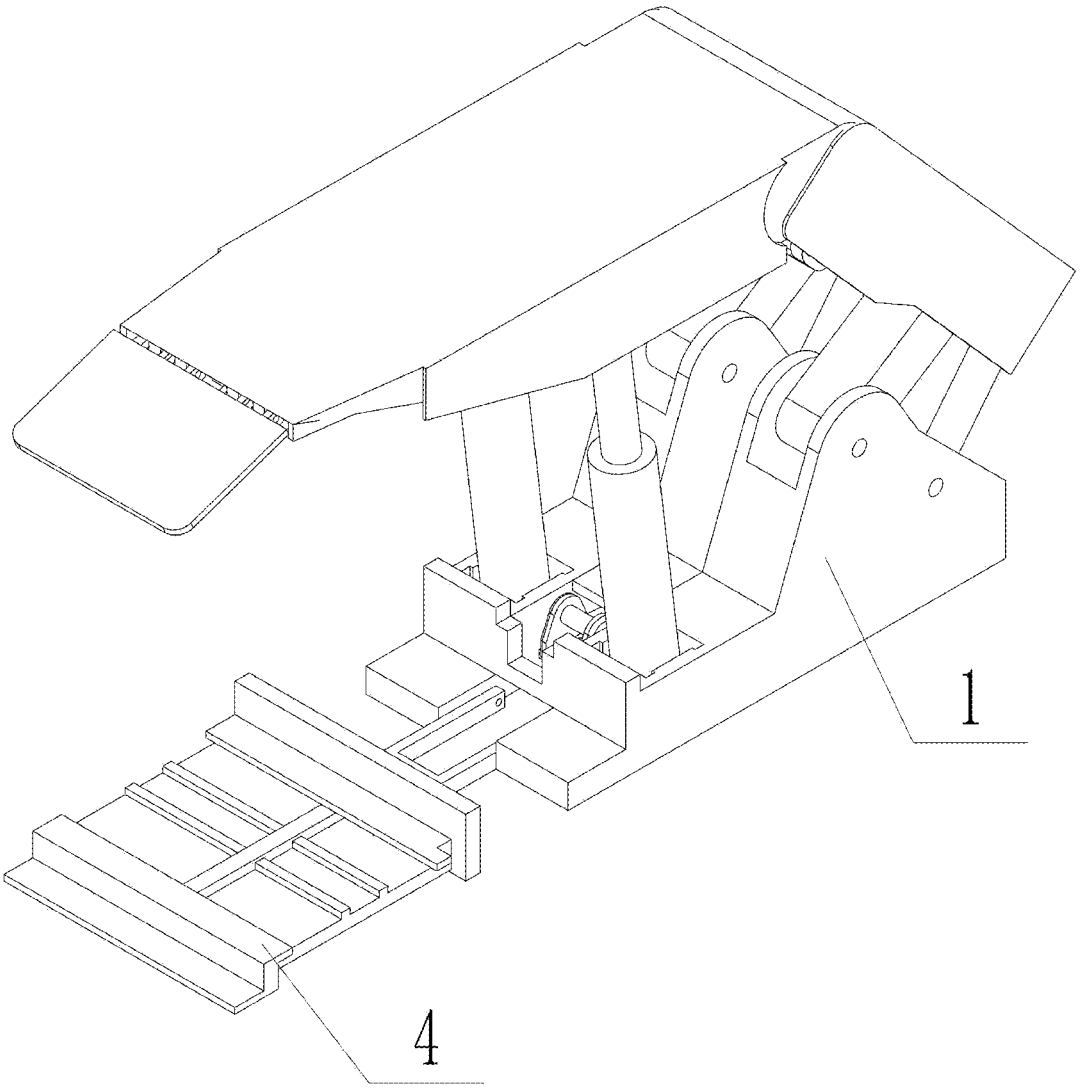
FIG. 4 is a structural schematic diagram of hydraulic supports and a conveyor of a distributed coal cutting device for a Longwall face of a coal mine in the present disclosure.
Figure 5:
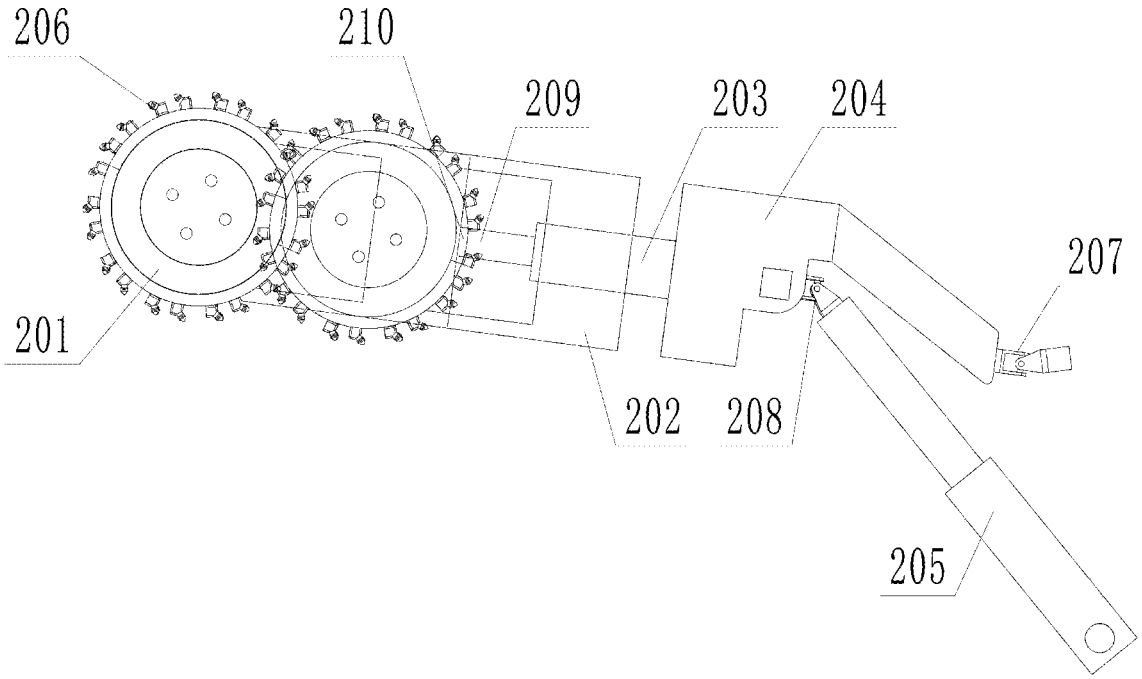
FIG. 5 is a structural schematic diagram of a coal cutting machine of a distributed coal cutting device for a Longwall face of a coal mine in the present disclosure.
Figure 6:
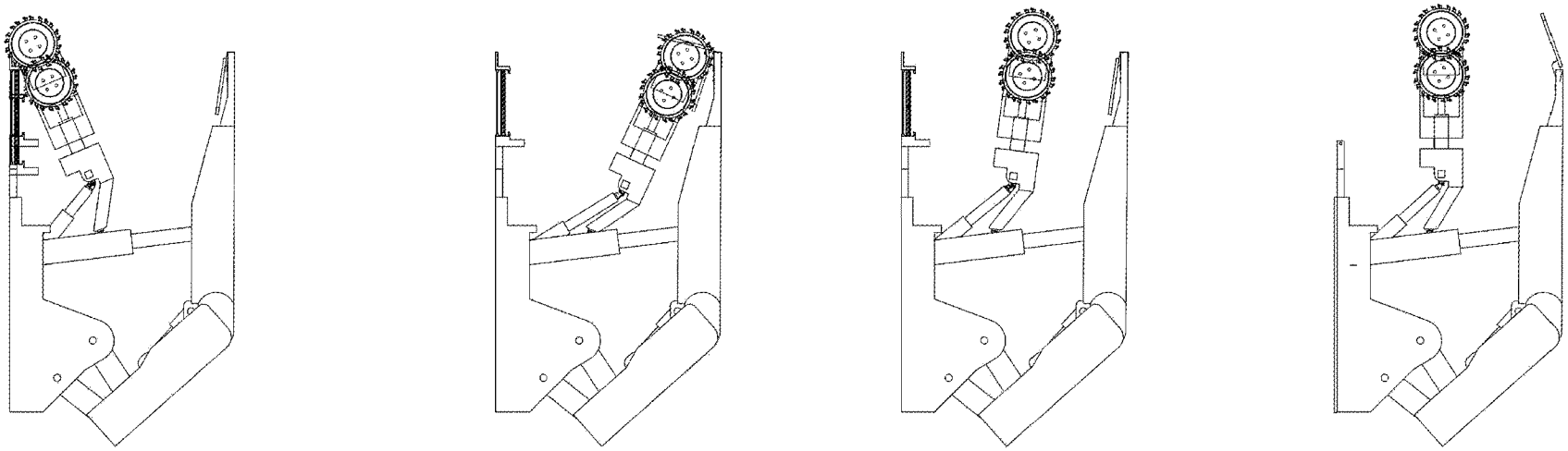
FIG. 6 is a working schematic diagram of a coal cutting machine of a distributed coal cutting device for a Longwall face of a coal mine in the present disclosure.
Figure 7:
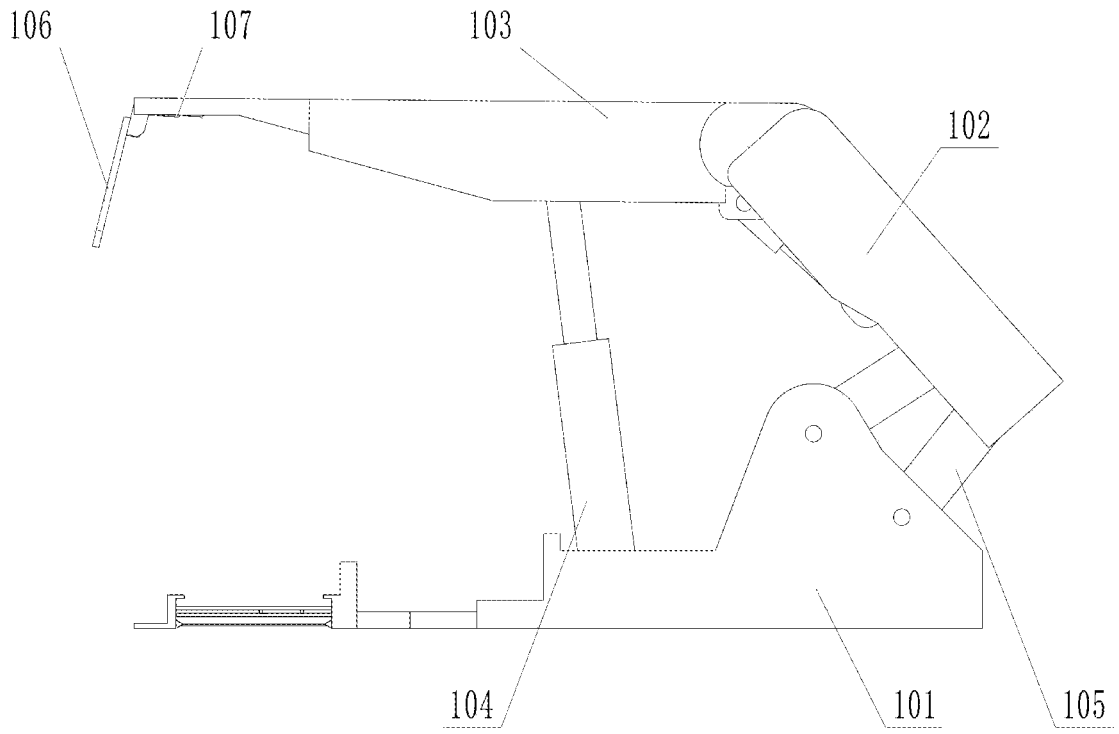
FIG. 7 is a structural schematic diagram of a hydraulic support of a distributed coal cutting device for a Longwall face of a coal mine in the present disclosure.
Figure 8:
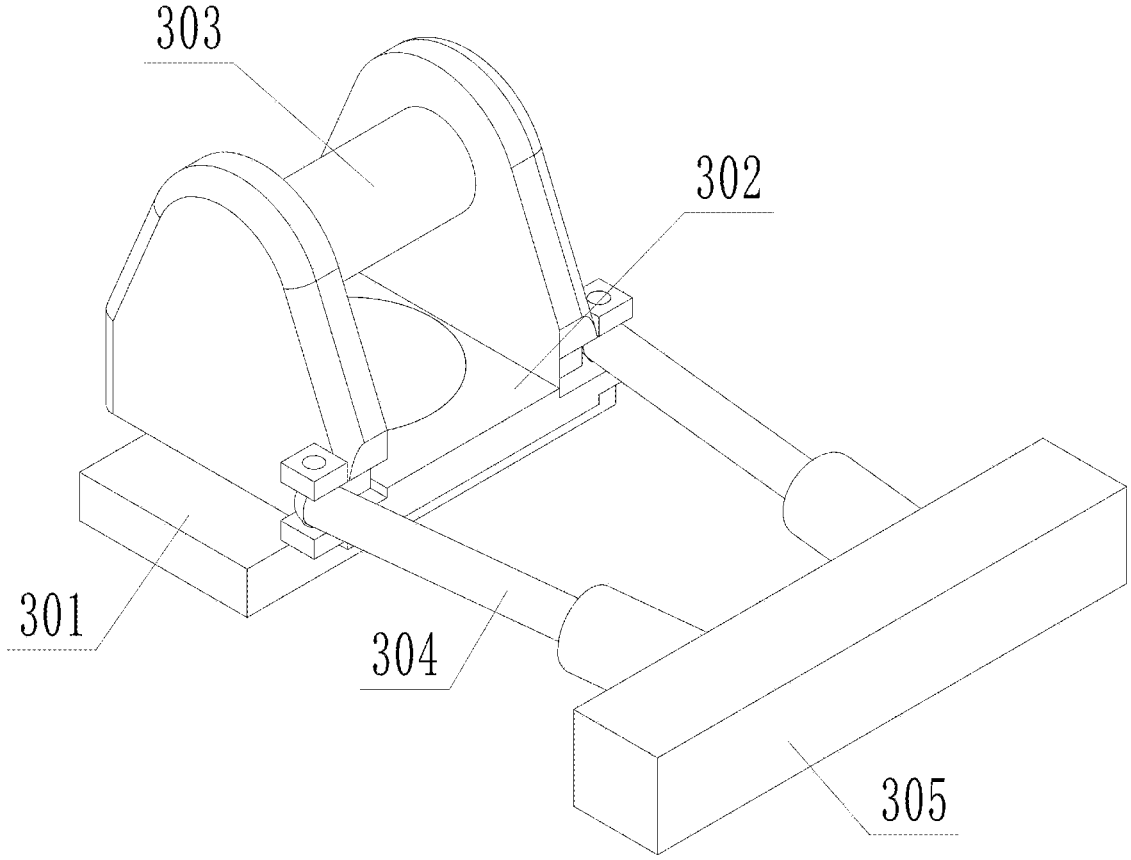
FIG. 8 is a structural schematic diagram of a rotating assembly of a distributed coal cutting device for a Longwall face of a coal mine in the present disclosure.
Figure 9:
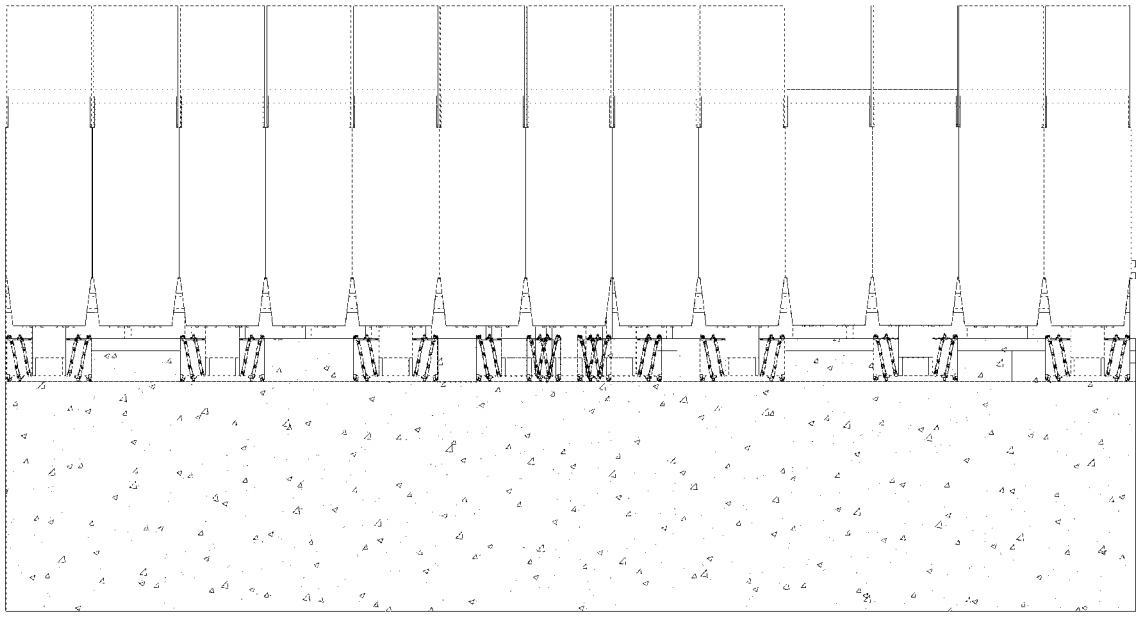
FIG. 9 is a working schematic diagram of a distributed coal cutting device for a Longwall face of a coal mine in the present disclosure.

Referring to FIG. 1 to FIG. 9, FIG. 1 is a structural schematic diagram of a distributed coal cutting device for a Longwall face of a coal mine in the present disclosure; FIG. 2 is a structural schematic diagram of a coal cutting unit of a distributed coal cutting device for a Longwall face of a coal mine in the present disclosure; FIG. 3 is a structural schematic diagram of a coal cutting machine and hydraulic supports of a distributed coal cutting device for a Longwall face of a coal mine in the present disclosure; FIG. 4 is a structural schematic diagram of hydraulic supports and a conveyor of a distributed coal cutting device for a Longwall face of a coal mine in the present disclosure; FIG. 5 is a structural schematic diagram of a coal cutting machine of a distributed coal cutting device for a Longwall face of a coal mine in the present disclosure; FIG. 6 is a working schematic diagram of a coal cutting machine of a distributed coal cutting device for a Longwall face of a coal mine in the present disclosure; FIG. 7 is a structural schematic diagram of a hydraulic support of a distributed coal cutting device for a Longwall face of a coal mine in the present disclosure; FIG. 8 is a structural schematic diagram of a rotating assembly of a distributed coal cutting device for a Longwall face of a coal mine in the present disclosure; and FIG. 9 is a working schematic diagram of a distributed coal cutting device for a Longwall face of a coal mine in the present disclosure.

The distributed coal cutting device 100 for a Longwall face of a coal mine provided by the present disclosure comprises coal cutting units 200, wherein each coal cutting unit 200 comprises one coal cutting machine 2 and two hydraulic supports 1. The two hydraulic supports 1 are arranged side by side. The arrangement direction of the two hydraulic supports 1 is parallel to the coal wall of the Longwall face. The hydraulic supports 1 can support a roof of the Longwall face. The coal cutting machine 2 is connected with one of the hydraulic supports 1. The coal cutting machine 2 is rotatably connected with the hydraulic supports 1. The coal cutting machine 2 is parallel to the coal wall of the Longwall face relative to the rotating axes of the hydraulic supports 1. The coal cutting machine 2 can carry out coal cutting operation. The number of the coal cutting units 200 is multiple, the multiple coal cutting units 200 are arranged side by side, and the arrangement direction of the multiple coal cutting units 200 is parallel to the coal wall of the Longwall face.

The distributed coal cutting device 100 for a Longwall face of a coal mine in the present disclosure comprises multiple coal cutting units 200 arranged side by side. Each coal cutting unit comprises a coal cutting machine 2. Multiple coal cutting machines 2 are used for simultaneously carrying out coal cutting operation, and single-point coal cutting is changed into multiple-point simultaneous coal cutting, so that the coal cutting production capacity and the production efficiency are greatly improved. The multiple coal cutting machines 2 can derive multiple control modes, so that the production flexibility and adaptability are improved. Wherein, each coal cutting unit 200 comprises one coal cutting machine 2 and two hydraulic supports 1. The hydraulic supports 1 can support a roof of the Longwall face. The coal cutting machine 2 is rotatably connected with the hydraulic supports 1, and the operation angle of the coal cutting machine 2 is adjusted, so that the coal cutting machine 2 can carry out coal cutting operation on the coal wall in the range of the adjacent hydraulic supports 1. Under the condition that multiple coal cutting units 200 are arranged, the coal cutting operation range of each coal cutting machine 2 is increased as much as possible, and the working flexibility and the coal cutting working efficiency of the coal cutting machine 2 are improved. According to the distributed coal cutting device 100 for a Longwall face of a coal mine in the present disclosure, multi-point simultaneous coal cutting operation is achieved through the multiple coal cutting machines 2. The coal cutting machines 2 can be miniaturized. The manufacturing difficulty and the using cost of the coal cutting machines 2 are reduced. When one coal cutting machine 2 fails, other coal cutting machines 2 can work normally, so that the coal mine production reliability is improved. According to the distributed coal cutting device 100 for a Longwall face of a coal mine in the present disclosure, in the production process, large-range movement in the working face is not needed, power cables and pipelines do not need to move along with a machine, a fixed installation mode is basically adopted, and the production process is more convenient and safer.

Wherein, the coal cutting machine 2 is connected with the hydraulic support 1 through a rotating assembly 3. The rotating assembly 3 comprises a bottom plate 301, a connecting rotating disc 302 and a connecting pin shaft 303. The connecting rotating disc 302 is rotatably connected with the bottom plate 301. The connecting pin shaft 303 is fixed to the connecting rotating disc 302. The coal cutting machine 2 is rotatably connected with the connecting pin shaft 303. The rotating axis of the connecting rotating disc 302 is perpendicular to the axis of the connecting pin shaft 303, and the rotating axis of the connecting rotating disc 302 and the axis of the connecting pin shaft 303 are parallel to the coal wall of the Longwall face. The coal cutting machine 2 can rotate up and down relative to the hydraulic support 1 through the connecting pin shaft 303 so as to adjust the height during coal cutting operation. Meanwhile, the connecting rotating disc 302 can drive the coal cutting machine 2 to rotate relative to the bottom plate 301. Therefore, left-and-right rotation of the coal cutting machine 2 is realized, so that the coal cutting machine 2 can adjust the horizontal position during coal cutting operation.

Specifically, the rotating assembly 3 further comprises driving arms 304 and a connecting block 305. One end of each of the driving arms 304 is hinged to the connecting rotating disc 302, the hinging axis is parallel to the rotating axis of the connecting rotating disc 302, and the other ends of the driving arms 304 are connected with the connecting block 305. The lengths of the driving arms 304 can be changed. The connecting block 305 is connected with the hydraulic support 1. The number of the driving arms 304 is two. The two driving arms 304 are located on the two sides of the axis of the connecting rotating disc 302. The driving arms 304 are used for driving the connecting rotating disc 302 to rotate. The two driving arms 304 are arranged on the two sides of the rotating axis of the connecting rotating disc 302. The connecting rotating disc 302 is driven to rotate through retraction and extension of the driving arms 304. The driving arms 304 can be hydraulic cylinders. For example, when the left driving arm 304 retracts and the right driving arm 304 extends, the connecting rotating disc 302 rotates leftwards; and when the right side drive arm 304 retracts and the left side drive arm 304 is extended, the connecting rotating disc 302 rotates rightwards. It should be noted here that both the rotating angle and the limit angle of the connecting rotating disc 302 can be adjusted according to actual working conditions to meet the operation requirements of the coal cutting machine 2. In the specific embodiment, the maximum deviation angles of the coal cutting machine 2 towards the left and right sides are 15°, and can be adjusted according to the specific working conditions in actual production.

More specifically, the coal cutting machine 2 comprises a roller 201, a first power module 202, a pushing arm 203, a machine frame 204 and a lifting arm 205. The roller 201 is in transmission connection with the first power module 202, and can be connected with a speed reducer in actual operation so as to meet the requirement on the working rotating speed of the roller 201. The first power module 202 can drive the roller 201 to rotate. The rotating axis of the roller 201 is parallel to the coal wall of the Longwall face. A plurality of picks 206 are arranged on the peripheral face of the roller 201. The first power module 202 is connected with the machine frame 204 through the pushing arm 203. The length of the pushing arm 203 can be adjusted. The pushing arm 203 is arranged perpendicular to the rotating axis of the roller 201. The machine frame 204 is connected with the hydraulic support 1 through a first universal joint 207. The machine frame 204 is connected with the lifting arm 205 through a second universal joint 208 to ensure the movement flexibility 20. The end, away from the machine frame 204, of the lifting arm 205 is rotatably connected with the connecting pin shaft 303. The length of the lifting arm 205 can be adjusted. When the coal cutting machine 2 works, the first power module 202 can drive the roller 201 to rotate. The roller 201 drives the picks 206 to rotate to cut coal. The rotating axis of the roller 201 is parallel to the Longwall face of a coal mine, so that the rotating direction of the roller 201 is perpendicular to the coal wall. The roller 201 is pushed forwards under the action of the pushing arm 203 to directly cut coal. Compared with the advancing mode that the rotating direction of the roller is parallel to the coal wall in the prior art, the inclined cutting feeding process is omitted, and the coal cutting working efficiency is further improved. The lifting arm 205 can drive the roller 201 to move up and down so as to carry out coal cutting operation on coal walls of different heights. The machine frame 204 provides a stable installation foundation for the pushing arm 203 and the lifting arm 205. The machine frame 204 is connected with the hydraulic support 1, so that the working stability of the coal cutting machine 2 is improved.

It is further emphasized that the roller 201 is slidably connected with the first power module 202 through a translation joint 209. The roller 201 is parallel to the rotating axis of the roller 201 relative to the sliding direction of the first power module 202. The translation joint 209 is connected with a second power module 210. The second power module 210 drives the translation joint 209 to drive the roller 201 to reciprocate in the axis direction, so that the working area of the coal cutting machine 2 is increased. Therefore, a coal cutting area of the hydraulic support 1 area which is not connected with the coal cutting machine 2 is smoothly covered, so that the coal cutting working efficiency is improved. It needs to be explained that the left-and-right movement distance of the roller 201 can be obtained by superposing translation of the roller 201 and left-and-right deviation of the coal cutting machine 2. In the specific embodiment, the movement distance is not smaller than half of the width of the hydraulic support 1 (0.8 m). The specific movement distance can be adjusted according to the specification of the hydraulic support 1 and the specific working condition.

Meanwhile, the roller 201 comprises a connecting section 201*a* and cutting sections 201*b*. The number of the cutting sections 201*b* is two. The two cutting sections 201*b* are arranged at the two ends of the connecting section 201*a*. The connecting section 201*a* and the cutting sections 201*b* are coaxially arranged. The connecting section 201*a* is connected with the first power module 202. The picks 206 are arranged at the cutting sections 201*b*. The connecting section 201*a* facilitates the connection of the roller 201 with other components. The connecting section 201*a* does not carry out coal cutting operation, but when the roller 201 moves left and right, the cutting sections 201*b* can carry out coal cutting operation on the area where the connecting section 201*a* is located. The roller 201 in the present disclosure is small in diameter and large in torque, can efficiently cut rock stratums and rock seams, and is higher in adaptability to complex conditions such as crossing faults and collapse columns of the working face; and the abrasion and consumption cost of a single or part of the coal cutting machine 2 and accessories is low, and the maintenance and replacement are more convenient.

It is further emphasized that the number of the picks 206 is multiple. The multiple picks 206 are spirally arranged around the axes of the cutting sections 201*b*, and the picks 206 on the two cutting sections 201*b* are symmetrically arranged with the center line of the connecting section 201*a* as the axis. The multiple spiral picks 206 are arranged, so that the coal cutting work efficiency of the roller 201 is further improved, and the cutting capacity of the roller 201 is enhanced.

Further, the hydraulic support 1 comprises a base 101, a caving shield 102, a top beam 103 and a stand column 104. The top beam 103 is arranged at the top of the base 101. One end of the caving shield 102 is connected with the top beam 103, and the other end of the caving shield 102 is connected with the base 101 through connecting rods 105. The connecting rods 105 are rotatably connected with the base 101. The top beam 103, the caving shield 102 and the base 101 form a U-shaped structure. An opening of the U-shaped structure faces the coal wall of the Longwall face. The coal cutting machine 2 is arranged in the U-shaped structure. The stand column 104 is connected with the top beam 103 and the base 101. The height of the stand column 104 can be adjusted. In actual operation, the angle between the caving shield 102 and the base 101 can be adjusted through the connecting rods 105. The caving shield 102 is hinged to the top beam 103, and the angle between the caving shield 102 and the top beam 103 continues to be adjusted, so that the hydraulic support 1 provides a safe and reliable working space for the coal cutting machine 2 while playing a supporting role. The stand column 104 can support the top beam 103, so that the stability of the hydraulic support 1 is further improved.

Besides, the hydraulic support 1 further comprises a guard plate 106. The guard plate 106 is rotatably connected with the top beam 103. The guard plate 106 is arranged on the side, away from the caving shield 102, of the top beam 103. The guard plate 106 is connected with a driving hydraulic cylinder 107, and the driving hydraulic cylinder 107 can drive the guard plate 106 to rotate. The guard plate 106 is hinged to the top beam 103. The guard plate 106 can be unfolded to prevent side caving when the coal cutting machine 2 carries out middle-position or bottom coal cutting. When the coal cutting machine 2 carries out top coal cutting, the guard plate 106 rotates and retracts back to the bottom of the top beam 103, so that normal work of the coal cutting machine 2 is prevented from being affected.

Further, the hydraulic support 1 is connected with the conveyor 4. The conveyor 4 can convey coal mined by the coal cutting machine 2. A pushing module is arranged between the hydraulic support 1 and the conveyor 4. The pushing module can drive the conveyor 4 and the hydraulic support 1 to move. The conveyor 4 is in one-to-one correspondence with the hydraulic support 1. A complete conveying system formed by the multiple conveyors 4 is used for conveying coal materials. When the device needs to integrally move forwards in the coal cutting process, the pushing module firstly pushes the conveyor 4 forwards and then drives the hydraulic machine frame 204 and the coal cutting machine 2 to move forwards, the pushing, sliding and frame moving procedures are completed, and the coal cutting procedure of the next cycle is started. In other embodiments of the present disclosure, the conveyor 4 can be a scraper conveyor. It should be noted here that the coal cutting machine 2 moves by means of the hydraulic support 1, the relative position in the working face is basically unchanged, and the coal cutting machine 2 does not need to move in a large range in the working face. Therefore, the coal cutting machine 2 does not need to be equipped with a mobile power source and related accessories. The equipment is greatly simplified, the manufacturing and assembling technical requirements are low, the stand-alone equipment is simplified in structure, the manufacturing cost is reduced, and the overall reliability of the stand-alone equipment can be improved.

According to the distributed coal cutting device 100 for a Longwall face of a coal mine, every two hydraulic supports 1 are provided with one coal cutting machine 2. The coal cutting machine 2 can cut a supporting roof at the upper part, a bottom plate at the lower part and the part from the left side to the right side with a distance not smaller than half of the width of the hydraulic support 1 in the one-time working process. In the same Longwall face, multiple coal cutting units 200 are matched, and the hydraulic support 1 and the conveyor 4 interact to advance forwards, so that the effect of simultaneously carrying and cutting the coal wall of the working face at multiple points is achieved, and the conditions of less mining and mining missing are avoided. In the production process of the coal cutting machine 2, the coal cutting machine 2 does not move in a large range in the working face, and power cables and pipelines do not need to move along with the coal cutting machine and are basically fixedly installed, so that the production process is more convenient and safer. In actual operation, intelligent management and control and fault processing are carried out on the multiple coal cutting machines 2, so that the overhauling workload increased due to the increase of the number of working face equipment can be remarkably reduced.

Specific examples are used for illustration of the principles and implementation methods of the present disclosure. The description of the above-mentioned embodiments is used to help illustrate the method and its core principles of the present disclosure. In addition, those skilled in the art can make various modifications in terms of specific embodiments and scope of application in accordance with the teachings of the present disclosure. In conclusion, the content of this specification shall not be construed as a limitation to the present disclosure.

What is claimed is:

1. A distributed coal cutting device for a Longwall face of a coal mine, comprising:

coal cutting units, wherein each coal cutting unit comprises one coal cutting machine and two hydraulic supports, the two hydraulic supports are arranged side by side, the arrangement direction of the two hydraulic supports is parallel to the coal wall of the Longwall face, the two hydraulic supports are capable of supporting a roof of the Longwall face, the coal cutting machine is connected with one of the two hydraulic supports, the coal cutting machine is rotatably connected with the two hydraulic supports, the coal cutting machine is parallel to the coal wall of the Longwall face relative to rotating axes of the two hydraulic supports, and the coal cutting machine is capable of carrying out coal cutting operation; and the number of the coal cutting units is multiple, the multiple coal cutting units are arranged side by side, and the arrangement direction of the multiple coal cutting units is parallel to the coal wall of the Longwall face;

the coal cutting machine is connected with the hydraulic support through a rotating assembly, the rotating assembly comprises a bottom plate, a connecting rotating disc and a connecting pin shaft, the connecting rotating disc is rotatably connected with the bottom plate, the connecting pin shaft is fixed to the connecting rotating disc, the coal cutting machine is rotatably connected with the connecting pin shaft, the rotating axis of the connecting rotating disc is perpendicular to the axis of the connecting pin shaft, and the rotating axis of the connecting rotating disc and the axis of the connecting pin shaft are parallel to the coal wall of the Longwall face;

wherein the coal cutting machine comprises a roller, a first power module, a pushing arm, a machine frame and a lifting arm, the roller is in transmission connection with the first power module, the first power module is capable of driving the roller to rotate, the rotating axis of the roller is parallel to the coal wall of the Longwall face, a plurality of picks are arranged on the peripheral face of the roller, the first power module is connected with the machine frame through the pushing arm, the length of the pushing arm is capable of being adjusted, the pushing arm is arranged perpendicular to the rotating axis of the roller, the machine frame is connected with the hydraulic support through a first universal joint, the machine frame is connected with the lifting arm through a second universal joint, the end, away from the machine frame, of the lifting arm is rotatably connected with the connecting pin shaft, and the length of the lifting arm is capable of being adjusted.

2. The distributed coal cutting device for a Longwall face of a coal mine according to claim 1, wherein the rotating assembly further comprises driving arms and a connecting block, one end of each of the driving arms is hinged to the connecting rotating disc, the other ends of the driving arms are connected with the connecting block, the lengths of the driving arms are capable of being changed, the connecting block is connected with the hydraulic support, the number of the driving arms is two, and the two driving arms are located on the two sides of the axis of the connecting rotating disc.

3. The distributed coal cutting device for a Longwall face of a coal mine according to claim 2, wherein the hydraulic support is connected with a conveyor, the conveyor is capable of conveying coal mined by the coal cutting machine, a pushing module is arranged between the hydraulic support and the conveyor, and the pushing module is capable of driving the conveyor and the hydraulic support to move.

4. The distributed coal cutting device for a Longwall face of a coal mine according to claim 1, wherein the roller is slidably connected with the first power module through a translation joint, the roller is parallel to the rotating axis of the roller relative to the sliding direction of the first power module, and the translation joint is connected with a second power module.

5. The distributed coal cutting device for a Longwall face of a coal mine according to claim 4, wherein the hydraulic support is connected with a conveyor, the conveyor is capable of conveying coal mined by the coal cutting machine, a pushing module is arranged between the hydraulic support and the conveyor, and the pushing module is capable of driving the conveyor and the hydraulic support to move.

6. The distributed coal cutting device for a Longwall face of a coal mine according to claim 1, wherein the roller comprises a connecting section and cutting sections, the number of the cutting sections is two, the two cutting sections are arranged at the two ends of the connecting section, the connecting section and the cutting sections are coaxially arranged, the connecting section is connected with the first power module, and the picks are arranged at the cutting sections.

7. The distributed coal cutting device for a Longwall face of a coal mine according to claim 6, wherein the number of the picks is multiple, the multiple picks are spirally arranged around the axis of the cutting section, and the picks on the two cutting sections are symmetrically arranged with the center line of the connecting section as the axis.

8. The distributed coal cutting device for a Longwall face of a coal mine according to claim 7, wherein the hydraulic support is connected with a conveyor, the conveyor is capable of conveying coal mined by the coal cutting machine, a pushing module is arranged between the hydraulic support and the conveyor, and the pushing module is capable of driving the conveyor and the hydraulic support to move.

9. The distributed coal cutting device for a Longwall face of a coal mine according to claim 6, wherein the hydraulic support is connected with a conveyor, the conveyor is capable of conveying coal mined by the coal cutting machine, a pushing module is arranged between the hydraulic support and the conveyor, and the pushing module is capable of driving the conveyor and the hydraulic support to move.

10. The distributed coal cutting device for a Longwall face of a coal mine according to claim 1, wherein the hydraulic support comprises a base, a caving shield, a top beam and a stand column, the top beam is arranged at the top of the base, one end of the caving shield is connected with the top beam, the other end of the caving shield is connected with the base through connecting rods, the connecting rods are rotatably connected with the base, the top beam, the caving shield and the base form a U-shaped structure, an opening of the U-shaped structure faces the coal wall of the Longwall face, the coal cutting machine is arranged in the U-shaped structure, the stand column is connected with the top beam and the base, and the height of the stand column is capable of being adjusted.

11. The distributed coal cutting device for a Longwall face of a coal mine according to claim 10, wherein the hydraulic support further comprises a guard plate, the guard plate is rotatably connected with the top beam, the guard plate is arranged on the side, away from the caving shield, of the top beam, the guard plate is connected with a driving hydraulic cylinder, and the driving hydraulic cylinder is capable of driving the guard plate to rotate.

12. The distributed coal cutting device for a Longwall face of a coal mine according to claim 11, wherein the hydraulic support is connected with a conveyor, the conveyor is capable of conveying coal mined by the coal cutting machine, a pushing module is arranged between the hydraulic support and the conveyor, and the pushing module is capable of driving the conveyor and the hydraulic support to move.

13. The distributed coal cutting device for a Longwall face of a coal mine according to claim 10, wherein the hydraulic support is connected with a conveyor, the conveyor is capable of conveying coal mined by the coal cutting machine, a pushing module is arranged between the hydraulic support and the conveyor, and the pushing module is capable of driving the conveyor and the hydraulic support to move.

14. The distributed coal cutting device for a Longwall face of a coal mine according to claim 1, wherein the hydraulic support is connected with a conveyor, the conveyor is capable of conveying coal mined by the coal cutting machine, a pushing module is arranged between the hydraulic support and the conveyor, and the pushing module is capable of driving the conveyor and the hydraulic support to move.

15. The distributed coal cutting device for a Longwall face of a coal mine according to claim 1, wherein the hydraulic support is connected with a conveyor, the conveyor is capable of conveying coal mined by the coal cutting machine, a pushing module is arranged between the hydraulic support and the conveyor, and the pushing module is capable of driving the conveyor and the hydraulic support to move.

16. The distributed coal cutting device for a Longwall face of a coal mine according to claim 1, wherein the hydraulic support is connected with a conveyor, the conveyor is capable of conveying coal mined by the coal cutting machine, a pushing module is arranged between the hydraulic support and the conveyor, and the pushing module is capable of driving the conveyor and the hydraulic support to move.

* * * * *